US005294002A

United States Patent [19]

Moses

[11] Patent Number: 5,294,002

[45] Date of Patent: Mar. 15, 1994

[54] AIR SEPARATOR WITH SPIRAL STAVES

[75] Inventor: Darcy Moses, Rush City, Minn.

[73] Assignee: Crown Iron Works Company, Minneapolis, Minn.

[21] Appl. No.: 103,540

[22] Filed: Aug. 9, 1993

Related U.S. Application Data

[63] Continuation of Ser. No. 887,342, May 21, 1992, abandoned, which is a continuation of Ser. No. 753,926, Sep. 3, 1991, abandoned, which is a continuation of Ser. No. 592,184, Oct. 3, 1990, abandoned.

[51] Int. Cl.[5] ..... B07B 4/00

[52] U.S. Cl. ..... 209/135; 209/139.2; 209/145; 209/150

[58] Field of Search ..... 209/133, 134, 135, 138, 209/139.1, 139.2, 145, 150, 154

[56] References Cited

U.S. PATENT DOCUMENTS

| | | | |
|---|---|---|---|
| 1,522,151 | 1/1925 | Stebbins | 209/138 X |
| 2,766,880 | 10/1956 | Schaub et al. | 209/150 X |
| 4,288,318 | 9/1981 | Essmann et al. | 209/139.1 |
| 4,865,627 | 9/1989 | Dewitz et al. | 55/20 |
| 4,931,173 | 6/1990 | Lesher | 209/138 |
| 4,941,970 | 7/1990 | Ahs | 209/207 X |

FOREIGN PATENT DOCUMENTS

| | | | |
|---|---|---|---|
| 324469 | 1/1930 | United Kingdom | 209/138 |

*Primary Examiner*—Andres Kashnikow
*Assistant Examiner*—Joseph A. Kaufman
*Attorney, Agent, or Firm*—Nawrocki, Rooney & Sivertson

[57] ABSTRACT

Apparatus (10) for separating intermixed particulate materials. The apparatus (10) includes a housing (12) having a coaxial core (14) disposed therewithin to define an annular space (24) between the core (14) and the wall of the housing (12). A recirculator (46) is provided to provide gas to the housing (12) for cyclonic flow within the annular space (24). The intermixed particulate materials are introduced into the housing (12) and permitted to fall, under the influence of gravity, into the annular space (24) where separation is effected by interaction of the upwardly spiralling gas with the downwardly-passing, intermixed particulate materials.

10 Claims, 1 Drawing Sheet 10
12
36
66
54
34
32
30
64
62
44
60
42
72
74
56
68
70
76
22
38
78
14
46
18
20
24
40
48
52
58
16
50
26
28

AIR SEPARATOR WITH SPIRAL STAVES

CONTINUING DATA

This application is a continuation of Ser. No. 07/887,342, filed May 21, 1992, now abandoned, which is a continuation of Ser. No. 07/753,926, filed Sep. 3, 1991, now abandoned, which is a continuation of Ser. No. 07/592,184, filed Oct. 3, 1990, now abandoned.

TECHNICAL FIELD

The present invention deals with apparatus for separating one material from another. More specifically, however, the invention is related to the field of devices for separating two or more intermixed particulate materials. The primary focus of the invention is a feature wherein cyclonic action is employed to effect separation.

BACKGROUND OF THE INVENTION

Various applications exist wherein it is necessary to employ a device to separate particulate solids. For example, in the processing of vegetable granular materials having meat portions and hull portions to be separated therefrom, particles of each portion are intermixed as a result of processing. It is desirable and economically efficient to separate the meat portions from the hull portions for further disposition. The meat portions tend to be relatively large compared to the hull portions.

Other applications, of course, exist for separating intermixed granular materials. U.S. Pat. No. 2,795,329 (Shaub) illustrates a device for the separation of fine-grained portions from intermixed granular material. The device illustrated in that document allows introduction of a bulk product into a chamber by gravity flow through a center-line pipe. A blast pipe, having annular slots, provides a counter-current air stream which interacts with downwardly-moving granular flow.

Such a device serves to somewhat accomplish the goals of a particulate material separator and overcomes some of the shortcomings of the prior art. It is important, however, that both by-products of the separation action be able to be recovered and removed from the gas or other fluid being employed in the separation process. The Shaub '329 patent does not permit recovery and retrieval of all by-products.

U.S. Pat. No. 2,766,880 (Shaub et al.) is similar in its teachings to the Shaub patent previously discussed. Materials are introduced, by gravity flow, through a center-line pipe. Airflow through a series of louvered slots is introduced in a counter-current direction to the downwardly passing granular material. As in the case of the Shaub '880 patent, however, a basic deficiency continues to be present. Not all by-products of the process performed are able to be recovered and retrieved. Certainly, the gas employed in separation is not purified so that it can be recycled and used again.

It is to the desirable dictates of a separator outlined above and the shortcomings of the prior art that the present invention is directed. It is an improved separator which not only accomplishes efficient separation, but it is also one which provides for simultaneous removal of particulate materials from the gas being employed in operation of the separator.

SUMMARY OF THE INVENTION

The present invention is a device which is employed to separate intermixed particulate materials of different weights. The device includes a generally cylindrical, vertically-oriented housing. Received within the housing is a generally cylindrical core, and the core has a diameter smaller than that of the housing and is disposed substantially coaxial with the housing wall. A generally annular space is, thereby, defined between the core and the housing wall. A gas flow is tangentially introduced into the annular space between the core and the housing wall at an axial location between the upper and lower ends of the core. Such a flow, thereafter, spirals upwardly within the annular space. Means are also included for depositing intermixed particulate material into the housing so that it passes downwardly into the generally annular space. Speed of the gas flow is controlled so that heavier particulate material will continue to pass downwardly through the annular space under the influence of gravity. The speed of the gas flow is, however, sufficiently great so that lighter particulate material particles are blown upwardly by the gas flow.

In one embodiment of the invention, the upper end of the core is closed by a generally conically-shaped wall. In this embodiment, a center-line tube, substantially coaxial with the housing, is employed for depositing the intermixed particulate materials into the housing and onto the generally conically-shaped wall. As the intermixed particulate material passes downwardly under the influence of gravity through the tube for introduction of the materials through the housing, the intermixed materials fall onto the generally conically-shaped wall. Thereafter, they cascade downwardly along the wall and radially outward over the wall and into the generally annular space.

If desired, the tube for depositing the intermixed particulate material into the housing can carry, proximate its lower end, a generally cylindrical cowl. It is preferred that the cowl be coaxial with the tube by which it is carried. The cowl is open at its lower end and is provided with a diameter substantially the same as the diameter of the core. The cowl is disposed so that a lower annular edge thereof is closely spaced from the upper end of the core. As a result, an annular slot is defined, the slot affording egress to the granular material so that is can pass outwardly and downwardly into the annular space between the core and the housing wall.

In the preferred embodiment of the invention, an annular baffle, disposed within the housing at a location above the cowl, is provided. The baffle has a radially outward edge which engages the wall defining the housing, and a radially inward edge which is spaced from the tube through which material is deposited upon the core. An aperture in the housing wall is provided at a location immediately below the baffle in order to afford tangential exit from the housing to lighter particulate materials blown upwardly within the housing by the spiraling gas flow.

In some applications of the present invention, the lighter and heavier particulate materials can be adhered to one another. In order to facilitate contacting and separation, a plurality of spaced staves can be provided along the core. Such staves would, typically, extend radially from the core to the wall defining the housing.

A closed gas flow system is shown as being employed. Recirculation means are then provided to permit flow of gas, having moved upwardly through the annular space between the core and the housing wall, back to a lower location at which it is reintroduced into the housing. Valve means are included in the embodiment to facilitate vacation of air from the chamber within the housing along with particulate materials. This is accomplished since, as air is introduced into the system through the valve means, spiral flow of the air within the chamber will become more likely to exit through the aperture in the housing wall provided to afford tangential exit from the housing rather than returning through the recirculation means.

The present invention is thus an improved separator device for effecting separation of intermixed granular materials wherein grains have different weights. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figures 1, 2:
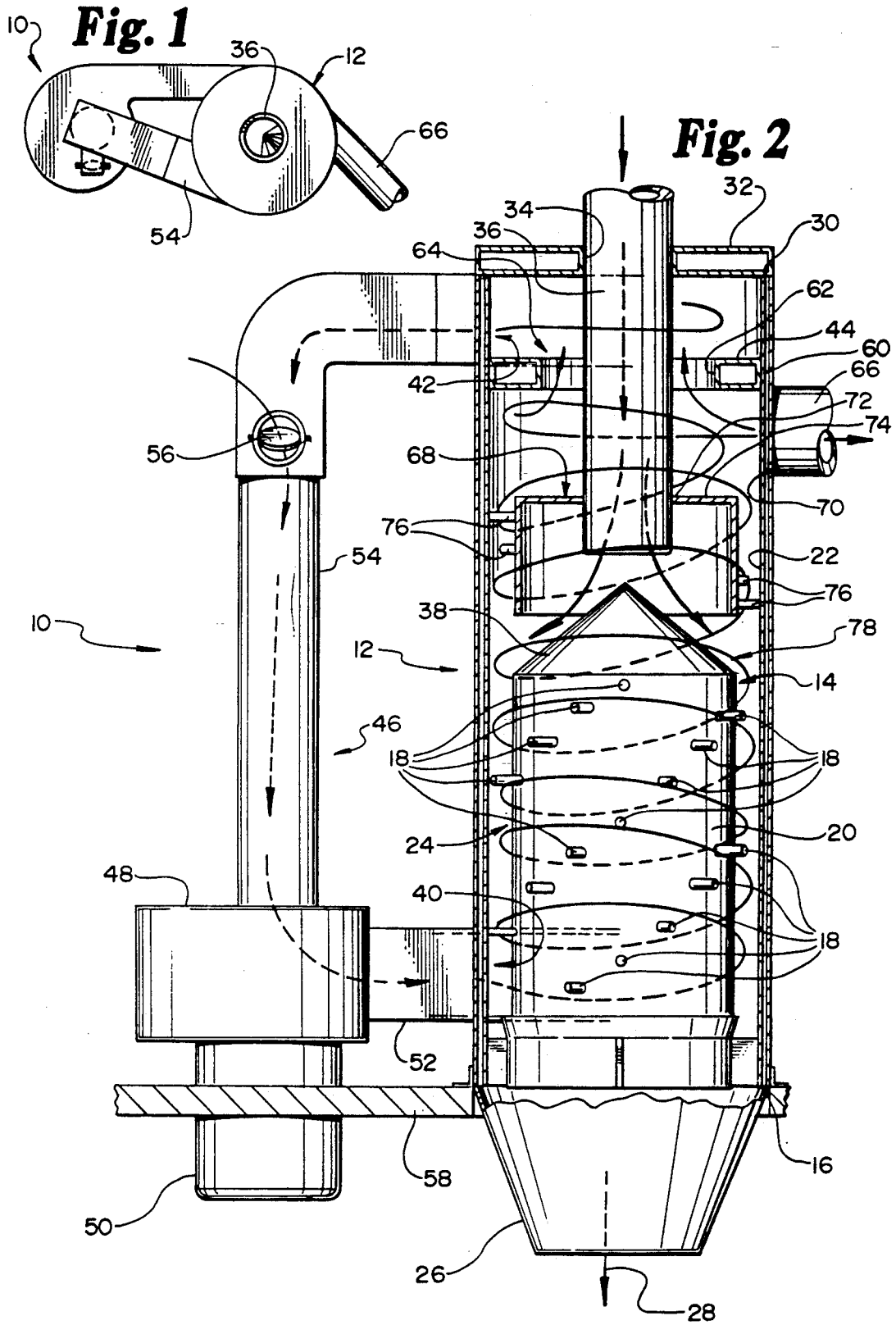
FIG. 1 is a top plan view of the separation system in accordance with the present invention.
FIG. 2 is an enlarged side view of the system in accordance with FIG. 1, the separation housing being shown in section.

Referring now to the drawing wherein like reference numerals denote like elements throughout the several views, FIG. 2 illustrates the apparatus 10 in accordance with the present invention. That figure illustrates a generally cylindrical housing 12 in which separation is effected. A generally cylindrical core 14 is mounted coaxially within the housing 12 proximate the bottom end 16 thereof. Mounting can be effected in any appropriate manner including by employment of a plurality of staves 18 extending radially between an outer wall 20 of the core 14 and an inner wall 22 of the housing 12. While these staves 18 can have, as one purpose, the mounting of the core 14 within the housing 12, they also serve an additional purpose that will be discussed hereinafter.

FIG. 2 shows the core 14 as extending approximately half-way up the vertical dimension of the housing 12. It will be understood, however, that cores shorter and longer, relative to the vertical dimension of the housing 12 could be employed.

The core 14 is provided with a diameter somewhat smaller than that of the housing 12. Consequently, an annular space 24 is defined between the outer wall 20 of the core 14 and the inner wall 22 of the housing 12. It is in this annular space 24 that separation of different sized particles of granular materials deposited into the housing 12 will take place.

FIG. 2 shows a funnel-like structure 26 at the bottom of the housing 12. As will be discussed hereinafter, heavier particulate material grains will pass downwardly through the annular space defined within the housing 12, and this funnel-like structure 26 is illustrated as being the first stage of recovery of these particles. Arrow 28 is illustrated to represent passage of these heavier granular particles downwardly through the funnel-like structure 26 to a location at which they are reclaimed.

FIG. 2 shows the upper end 30 of the housing 12 as being closed primarily by an annular wall 32 having a central aperture 34 formed therein. The aperture 34 is provided to accommodate a tube 36 having an axis of elongation generally parallel to the axis of elongation of the housing 12. While not essential to the invention, it is envisioned that the tube 36 would be mounted so that it would be disposed on the center-line of the housing 12. That is, it is desirable that the tube 36 be substantially coaxial with the housing 12. It is through this tube 36 that bulk granular materials including particles having different weights are deposited into the housing 12.

The core 14 is shown as having a generally conical upper wall 38. The apex of this conical wall 38 would, typically, be positioned on the center-line of the housing 12. Bulk granular materials being deposited into the housing 12 through the tube 36 will fall onto this upper closure wall 38 of the core 14, cascade downwardly and outwardly along the cone 38, and pass, under the influence of gravity, into the annular space 24 defined between the core 14 and the housing wall 22.

The housing 12 is provided with air inlet and egress ports 40, 42. The inlet port 40 is disposed proximate the lower end 16 of the housing 12, while the egress port 42 is provided proximate the housing's upper end 30. The lower, inlet port 40 is formed in the housing wall so that air is introduced into the housing 12 tangentially for cyclonic flow about the core 14 in the annular space 24 defined between the core 14 and the housing wall 22. The egress port 42, as best seen in FIG. 1, can also be disposed to provide or tangential exiting of the air, although this would not be essential to the invention. As the air has passed around the core 14 and upwardly within the housing 12, its tangential flow has been disrupted significantly by a baffle 44 that will be discussed hereinafter.

A gas recirculation system 46 is intended to be included for forcing gas, such as air, through the separator housing 12, as discussed hereinbefore. The circulation system 16 includes a fan 48 driven by a motor 50, a duct 52 extending from the fan 48 to the ingress port 40, and a return duct 54 extending from the egress port 42 back to the fan 48. As seen in FIG. 2, a valve 56 is shown as being provided in the return duct 54 for facilitating vacation of gas from the system along with particulate fines. As additional gas is introduced into the system through valve 56 in return duct 54, increased pressure will result in the housing 12, and spiralling gas within housing twelve will tend to more effectively pass out of the housing 12, along with particulate fines, through exit conduit 66. FIG. 2 also illustrates a mounting strut 58 mounting both the housing 12 and the recirculation components by way of the recirculation motor 50.

As previously mentioned, a baffle 44 is mounted within the housing 12 proximate its upper end 30. This baffle 44 takes the form of an annular wall which has an outer edge 60 in engagement with the inner surface of the wall defining the housing 12. An inner edge 62 of the baffle 44 is spaced outwardly from the tube 36 through which intermixed particulate materials are deposited into the housing 12. An annular space 64, spaced inwardly from the housing wall 22, is, thereby, defined.

The baffle 44 is located along the housing wall 22 at a position below the air egress port 42. At the same time, however, it is located substantially immediately above an exit conduit 66 through which, it is intended, particulate fines will be directed from the housing 12 for recovery. The exit conduit 66 provides for tangential exiting of the fines, and the swirling fines will be directed, by the baffle 44, into this conduit 66, since the baffle 44 will preclude further upward movement. The spiraling air, however, will have a tendency to migrate radially inwardly and will continue to pass upwardly within the housing 12 through the annular space 64 between the tube 36, through which the materials were deposited, and the baffle 44. The air will, thereafter, pass through the egress port 42 and the return conduit 54 to the fan 48.

In some embodiments, a cowl 68 is mounted so as to generally form an extension of the core 14. The cowl 68, therefore, is generally cylindrical and has a diameter substantially the same as that of the core 14. The axial dimension of the cowl 68 within the housing is slightly shorter than the distance between the upper end of the core 14 at which the core's cylindrical wall intersects the upper, generally conical, closure wall 38, and a lower lip 70 of the exit conduit 66 for fines. As a result, the cowl 68 can be mounted within the housing 12 so that a closed upper end thereof is slightly below the lower lip 70 of the exit conduit 66 and the lower end is closely spaced from the upper conical closure wall 38 of the core 14. Mounting can be effected in a number of ways. First, it can be supported from the depositing tube 36 by being welded thereto, as at 72, with a lower portion of the tube 36 extending below the upper wall 74 of the cowl 68. Further support, however, can be provided by a plurality of additional staves 76 extending from the annular wall of the cowl 68 in a radial direction to the cylindrical housing wall 22. Support is, thereby, in both lateral and vertical directions.

In view of the provision of the annular slot 78 between the lower end of the cowl 68 and the upper end of the core 14, particulate materials deposited into the housing 12 through the tube 36 will not be impeded from passing over the conical, upper wall 38 of the core 14 and into the annular space 24 between the core 14 and the housing wall 22. As previously mentioned, however, the cowl 68 will serve substantially as an extension of the core 14 in vertically upward direction. As a result, the velocity of the cyclonically moving air will be substantially uniform from the time it enters the housing 12 at the inlet port 40 until it reaches an axial location at the exit conduit 66. There will, of course, be some velocity diminishment as the air passes the annular slot 78 between the cowl 68 and the core 14, but the diminishment will be negligable from the standpoint of processing.

In some applications to which the present invention would be put, the larger particulate grains and smaller particulate grains might be adhered to one another. This would be true in an application such as one wherein a vegetable grain comprising adhered meats and hulls are being separated. Prior processing would, of course, have occurred and be intended to effect maximum separation. There will usually, however, be some unwanted adherence. The staves 18, 76 which can be provided traversing the annular space 24 between the core 14 and the housing wall 22, and the annular wall of the cowl 68 and the housing wall 22 can effect additional contacting of particles as they are worked upon by the upwardly moving air. Additional separation will, thereby, occur.

In operation, the materials to be processed would be deposited into, for example, a hopper (not shown) above the housing 12. They would, thereafter, pass, under the influence of gravity, downwardly through the center-line tube 36, onto the conical wall 38, and outwardly into the annular processing space 24 between the core 14 and the wall 22 of the housing 12. Simultaneously, cyclonic air movement would be induced within the housing 12 by means of the blower fan 48 by causing actuation of the drive motor 50. Motor 50 can be a variable-speed motor so that flow velocity can be regulated. It is also specifically contemplated, however, that damper controls (not shown) could be employed, in combination with a fixed-speed motor, to regulate flow velocity. The velocity would be adjusted so that it would be sufficiently strong to deflect the fine particulate materials (such as the hulls of a vegetable granular material) back upwardly so as to catch the fines in the cyclonic flow and pass them out of the housing 12 through the exit conduit 66. At the same time, however, the velocity would be sufficiently low so that the larger particles (that is, the meats) would be permitted to continue to pass downwardly within the housing 12, into the funnel-like structure 26, and for subsequent retrieval. As can be seen then, it is intended that all granular materials, whether fine or heavy, be passed out of the housing 12 through either the exit conduit 66 or the funnel-like structure 26, respectively. Only the air would continue radially inward movement at the baffle 44, through the annular space 64, and passage into the return conduit 54 for recirculation.

As will be able to be seen in view of this disclosure, gas flow within the housing 12 is cyclonic in nature along a substantial length of housing 12. The apparent vertical component of the cyclonic flow is at a controlled rate, while the actual flow velocity is relatively high. Consequently, more effective separation results. The high velocity of air is more effective in separating the particulate materials than in counter-current air flow systems known in the prior art.

Numerous characteristics and advantages of the invention covered by this document have been set forth in the foregoing description. It will be understood, however, that this disclosure is, in many respects, only illustrative. Changes may be made in details, particularly in matters of size, shape, and arrangement of parts, without exceeding the scope of the invention. The invention's scope is, of course, defined in the language in which the appended claims are expressed.

What is claimed is:

1. Apparatus for separating intermixed particulate materials of two different weights, wherein some of the particulate material of both weights is adhered to each other, comprising:

(a) a generally cylindrical, vertically-oriented housing;

(b) a generally cylindrical core, substantially coaxial with said housing, received within said housing to define a generally annular space, said core having upper and lower ends;

(c) a plurality of generally radially extending staves extending across said generally annular space and between said core and a wall defining said housing, said staves arranged in a generally spiralling array;

(d) means, intermediate said upper and lower ends of said core, for introducing a gas flow tangentially into said generally annular space; and (e) means for depositing the intermixed particulate material into said generally annular space proximate said upper end of said core;

(f) wherein particulate material of the two different weights passing through said generally annular space is contacted by said staves to effect separation of the adhered particulate material; and (g) wherein the gas flow passes spirally upward within the generally annular space at a speed wherein heavier particulate material particles continue downward passage, under the influence of gravity, and lighter particulate material particles are blown upwardly by the gas flow.

2. Apparatus in accordance with claim 1 wherein said upper end of said core is closed by a generally conically-shaped wall, and wherein said depositing means comprises a center-line tube, substantially coaxial with said housing, above said generally conically-shaped wall, wherein, as the intermixed particulate material passes downwardly, under the influence of gravity, through said tube and exits from a lower end thereof, the material falls onto said generally conically-shaped wall and cascades downwardly and radially outward over said wall into said generally annular space.

3. Apparatus in accordance with claim 2 wherein said tube carries, proximate said lower end thereof, a coaxial, generally-cylindrical cowl, said cowl being open at a lower end thereof and having a diameter substantially the same as a diameter of said core.

4. Apparatus in accordance with claim 3 wherein said lower end of said cowl is closely spaced from said upper end of said core to define an annular slot through which the intermixed particulate material passes after having cascaded over said generally conically-shaped wall.

5. Apparatus in accordance with claim 4 wherein said cowl includes a top closure wall extending from a peripheral wall of said cowl radially inwardly to said tube.

6. Apparatus in accordance with claim 5 further comprising a generally annular baffle disposed within said housing at a location above said top closure wall of said cowl, said baffle having a radially outward edge in engagement with a wall defining said housing, and a radially inward edge spaced from said tube.

7. Apparatus in accordance with claim 6 wherein said wall defining said generally cylindrical housing has a tangential exit port formed therein at a location immediately beneath said baffle.

8. Apparatus in accordance with claim 1 further comprising a generally annular baffle received within said housing at a location upwardly from said upper end of said core, said baffle having a radially outward edge in engagement with a wall defining said generally cylindrical housing and an aperture formed centrally therewithin.

9. Apparatus in accordance with claim 8 wherein said wall defining said generally cylindrical housing has a tangential exit port formed therein at a location immediately beneath said baffle.

10. A system for separating intermixed particulate materials of two different weights, wherein some of the particulate material of both weights is adhered to each other, comprising:

(a) a generally cylindrical, vertically-oriented housing;

(b) a generally cylindrical core, substantially coaxial with said housing, received within said housing to define a generally annular space, said core having upper and lower ends;

(c) a plurality of generally radially extending staves extending across said generally annular space and between said core and a wall defining said housing, said staves arranged in a generally spiralling array;

(d) means, intermediate said upper and lower ends of said core, for introducing a gas flow tangentially into said generally annular space;

(e) means for depositing the intermixed particulate material into said generally annular space proximate said upper end of said core; and (f) gas recirculation means communicating with said housing proximate said upper and lower ends thereof;

(g) wherein particulate material of the two different weights passing through said generally annular space is contacted by said staves to effect separation of the adhered particulate material; and (h) wherein the gas flow passes spirally upward within the generally annular space at a speed wherein heavier particulate material particles continue downward passage, under the influence of gravity, and lighter particulate material particles are blown upwardly by the gas flow.

* * * * *